United States Patent [19]

Edgecombe

[11] 4,203,273

[45] May 20, 1980

[54] TUBING WITH FORMED ENDS FOR HEAT EXCHANGERS

[75] Inventor: David A. Edgecombe, Alliance, Ohio

[73] Assignee: The Babcock & Wilcox Company, New Orleans, La.

[21] Appl. No.: 887,581

[22] Filed: Mar. 17, 1978

Related U.S. Application Data

[62] Division of Ser. No. 794,449, May 6, 1977, abandoned.

[51] Int. Cl.[2] ..... B65B 13/00; B65B 27/10

[52] U.S. Cl. ..... 53/399; 53/428; 206/443

[58] Field of Search ..... 29/428, 445, 400 D, 29/400 R, 400 M, 157.3 C, 157.4; 53/428, 444, 399; 206/443, 597

[56] References Cited

U.S. PATENT DOCUMENTS

| | | | |
|---|---|---|---|
| 935,723 | 10/1909 | Zimmermann | 228/212 |
| 1,423,478 | 7/1922 | Cary | 206/443 |
| 1,427,519 | 8/1922 | Cary | 206/443 |
| 3,220,583 | 11/1965 | Robertson | 206/443 |
| 3,283,893 | 11/1966 | Durocher et al. | 53/399 |
| 3,802,987 | 4/1974 | Noll | 206/443 |
| 3,897,821 | 8/1975 | Babunovic et al. | 29/157.4 |

*Primary Examiner*—Daniel C. Crane

*Attorney, Agent, or Firm*—R. J. Edwards; R. C. Mai

[57] ABSTRACT

A grouping of straight tubes, bundled and packed for shipment, having the tube ends on one end of the bundle deformed for locating and supporting the tubes in a tube sheet, with the deformations located and produced in a manner resulting in a compact shipping package and improvements in handling at the job site and place of manufacture.

2 Claims, 7 Drawing Figures

TUBING WITH FORMED ENDS FOR HEAT EXCHANGERS

This application is a division of U.S. patent application Ser. No. 794, 449 filed May 6, 1977 now abandoned.

BACKGROUND OF THE INVENTION

The field erection of straight tube heat exchangers, for example tubular air heaters containing many thousands of tubes, involves inserting the tubes in tube holes of tube sheets which are in parallel, spaced relationship, locating the tubes in the tube sheets to provide equal tube extensions from each tube sheet and welding or expanding the tubes to the tube sheets. In these operations it is necessary to provide a type of stop or locator on one end of the tubes to maintain equal tube extensions or protrusions from the tube sheets prior to welding or expanding. This is particularly important during the erection of heat exchangers with vertical tubes where it is possible that the tubes could pass completely through the tube sheets if these stops or locators were not provided. One method of providing this restraint is to flare one end of the tubes to a diameter greater than the tube hole. This is usually done at the tube manufacturing plant. Another method is to hand punch in the field one end of the tubes, forming dimples or extensions of the tube diameter to locate the tubes in the tube sheets and prevent passage through the tube sheets prior to welding or expanding. Flaring the tube ends is expensive and creates handling and shipping problems to the tube manufacturer. Straight tubes of equal outside diameters are usually bundled in a hexagonal shaped package for compactness and strapped for shipment. Obviously, a bundle of tubes with flared ends would be larged in diameter than a conventional bundle and the tapered configuration would make strapping or banding of the bundle unreliable and unsafe. It may, however, be possible to safely package tubes with flared ends using spacers of suitable design but this would be expensive and present handling problems in the manufacturing plant and at the job site. Alternating the tube ends is possible but this would only ease and not solve the handling and packaging problem. Hand punching the tubes at the job site is expensive and inaccurate and complicates erection problems.

SUMMARY OF THE INVENTION

The aforementioned problems are solved by the practice of this invention. A tool has been designed which, coupled to a commercially available impact machine, produces extended dimples on the tube ends after the tubes are packaged in a conventional hexagonal bundle. In a hexagonal bundle of round tubes, spaces exist between adjacent tubes that are circumferentially located 60 degrees apart. Preferably a tool with four wedge-shaped protuberances, spaced circumferentially 60 and 120 degrees apart, cold forges dimples in the tube ends and which protrude in the spaces between adjacent tubes, the foregoing operation taking place after the tube bundle is strapped and banded for shipment.

DESCRIPTION OF THE PREFERRED EMBODIMENT

Figure 1:
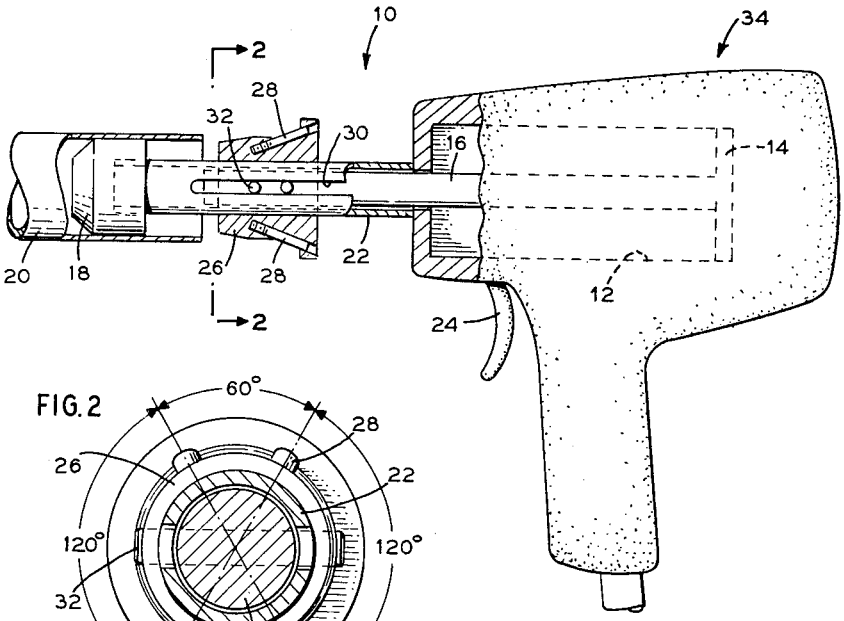
FIG. 1 is a partial sectional elevation view of a tube end forming tool assembly used in the practice of the invention.

FIG. 1 is an assembly 10 of the apparatus used in the preferred embodiment of the invention and is illustrated with one end positioned within a boiler or air heater tube 20 to deform the tube end when operated. Impact gun 34 can be selected from commercially available designs, such as a Model N 16 Nailer, manufactured by Bostitch, Division of Textron, Inc., in East Greenwich, R.I. and can be driven hydraulically, pneumatically, electrically or mechanically. Operation of trigger 24 actuates piston 14 and piston rod 16 in cylinder 12. The portion of piston rod 16 external to gun body 34 is slidably encased in piston rod guide tube 22. One end of tube 22 is welded or threaded to gun 34 and the other end is similarly attached to tube guide 18. The tube guide 18 directs and guides that portion of the apparatus external to gun body 34 into the workpiece or tube 20. A driver 26 is slidably engaged over guide tube 22 and is fixed to piston rod 16 by driver pins 32. The driver pins 32 slidably extend through slots 30 in the guide tube 22, shown also in FIG. 2. The slots are parallel to the longitudinal axis of the piston rod 16 and produce only linear motion of the piston 16, the driver 26 and the tube guide 18. The driver 26 is fitted with wedge-shaped upsetting pins or protuberances 28 which are fixed to the driver 26 and inclined to the longitudinal axis of the piston 16.

Figure 2:
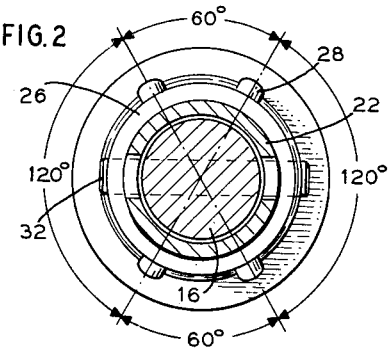
FIG. 2 is an enlarged sectional end view of the tool assembly taken along line 2—2 of FIG. 1.

FIG. 2 shows a sectional view of the apparatus with a driver 26 fitted with four wedge-shaped upsetting pins or protuberances 28 circumferentially spaced on the driver 26 and 60 and 120 degrees.

Figure 3:
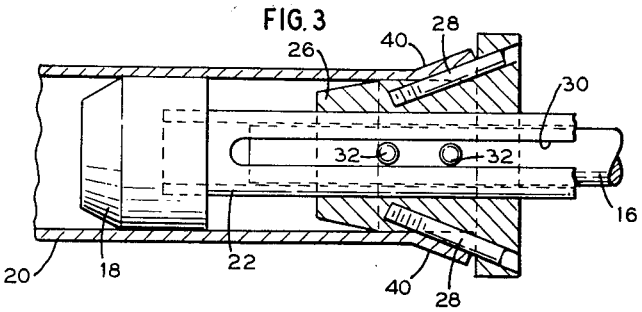
FIG. 3 is a sectional view of a boiler or air heater tube with one end deformed in accordance with the invention.

FIG. 3 depicts a portion of the apparatus after actuation of the impact gun 34 with the driver 26 partially within tube 20 and upset dimples 40 formed in one end and projecting outwardly of tube 20 by the action of upsetting pins 28.

Figure 4:
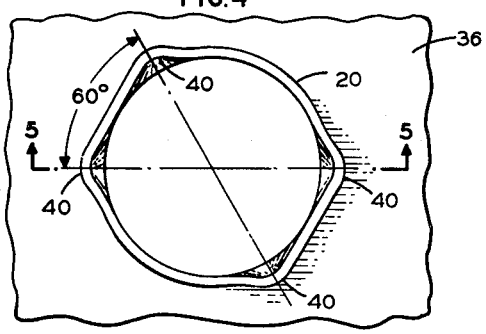
FIG. 4 is a top view of a boiler or air heater tube showing the tube end deformation.

FIG. 4 illustrates an end view of tube 20 with upset dimples 40 formed by a driver with four upsetting pins. Although a tool producing four dimples has been used, only one wedge-shaped protuberance is necessary in the practice of the invention. If a tool with a plurality of wedge-shaped protuberances is used, they are circumferentially spaced at 60 degrees or at multiples of 60 degrees. As many as six protuberances or as few as one may be used.

Figure 5:
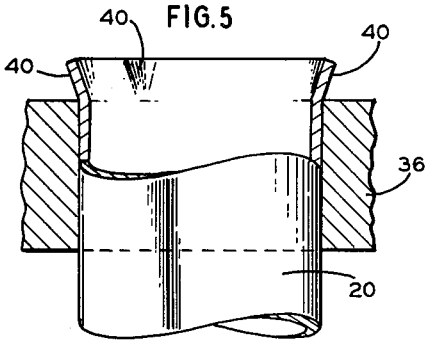
FIG. 5 is a sectional elevation taken along lines 5—5 of FIG. 4 and illustrates the tube as installed in a tube sheet.

Shown in FIG. 5 is a portion of tube 20 installed in tube sheet 36 and located in place by upset dimples 40 prior to welding or expanding the tube in the tube sheet.

Figure 6:
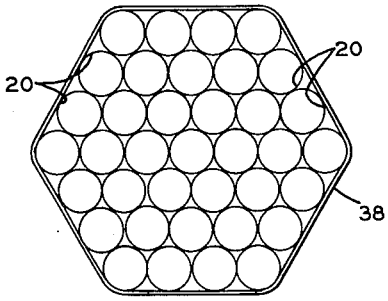
FIG. 6 illustrates a bundle of tubes packed and strapped for shipment but prior to tube end deformation.

A bundle of 37 tubes packed and strapped for shipment is illustrated in FIG. 6. The tubes 20 are shown in an hexagonal bundle and are held in place by a number of tube bundle straps 38 placed along the length of the bundle. A greater or lesser number of tubes can be packed in one bundle depending on size or weight limitations.

Figure 7:
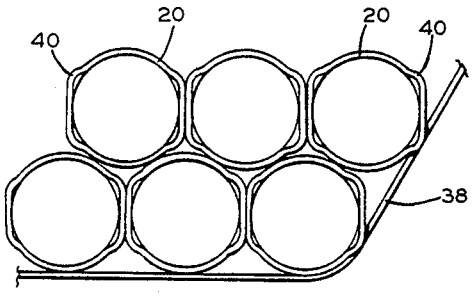
FIG. 7 is an enlarged portion of FIG. 6 showing the tube ends after deformation.

FIG. 7 shows a portion of the tube bundle depicted in FIG. 6 with upset dimples 40 in tubes 20 formed in accordance with the preferred embodiment of the invention. It is, of course, understood that tube bundle straps 38 are not installed at the extremity of the bundle and do not interfere with any dimples formed at the end of the bundle.

In the practice of the invention, a number of tubes are packed and bundled, usually in a hexagonal array, and secured by straps located along the length of the bundle. The tube bundle is then placed on a stand or support which has a backup plate at one end. The purpose of this backup plate is to prevent the tubes from being jolted out of position during use of the impact gun. The upset dimples are then formed with the impact gun apparatus, locating the dimples or protuberances in the spaces between tubes. The result is a tight, compact bundle of tubes with upset ends formed at one end of the bundle and having the same cross sectional area as a bundle of an equal number of tubes without upset ends. Handling and shipping charges represent a significant portion of the total tube cost. Upsetting the tube ends in the manner described greatly reduces handling costs both at the tube mill and the job site and the tight, compact tube bundle provides a safe, economic mode of shipment, all of which represents a significant advance in the art.

I claim:

1. A method of preparing a group of straight length round tubes of equal outside diameter for shipment after being strapped in a bundle, comprising, arranging the tubes parallel to each other in a compact and contacting array and producing triangular-like spaces having curved sides between the tubes, strapping the tubes in a bundle for shipment, and then forming on one end of each tube a projection in one of the spaces between the tubes, produced by cold forging dimples in the tube ends, thus deforming the tube ends, and maintaining for the bundle so formed the same cross-sectional area as a bundle of an equal number of tubes without end projections.

2. The method of claim 1 wherein a plurality of circumferentially spaced projections are formed in the spaces between tubes.

* * * * *

UNITED STATES PATENT AND TRADEMARK OFFICE

CERTIFICATE OF CORRECTION

PATENT NO. : 4,203,273

DATED : May 20, 1980

INVENTOR(S) : David A. Edgecombe .

It is certified that error appears in the above-identified patent and that said Letters Patent are hereby corrected as shown below:

On Title Page, under Related U.S. Application Data, "[62] Division of Ser. No. 794,449, May 6, 1977, abandoned" should read ... [62] Division of Ser. No. 794,449, May 6, 1977. ...

Column 1, lines 5, 6 and 7, after "application Ser. No. 794,449 filed May 6, 1977" delete ... now abandoned ...

Column 1, line 35, "larged" should read ... larger ...

Column 2, line 38, after "piston" insert ... rod ...

Signed and Sealed this

*Twelfth* Day of *August 1980*

[SEAL]

*Attest:*

SIDNEY A. DIAMOND

*Attesting Officer*

*Commissioner of Patents and Trademarks*